US006755186B2

(12) United States Patent
Brookshire et al.

(10) Patent No.: US 6,755,186 B2
(45) Date of Patent: Jun. 29, 2004

(54) EGR SYSTEM FLEXIBLE GAS CONNECTION JOINT

(75) Inventors: Dennis L. Brookshire, Bolingbrook, IL (US); Glenn F. Thompson, Palos Verdes Estates, CA (US)

(73) Assignee: Honeywell International, Inc., Norristown, NJ (US)

( * ) Notice: Subject to any disclaimer, the term of this patent is extended or adjusted under 35 U.S.C. 154(b) by 0 days.

(21) Appl. No.: 10/280,869

(22) Filed: Oct. 24, 2002

(65) Prior Publication Data

US 2003/0075157 A1 Apr. 24, 2003

Related U.S. Application Data

(60) Provisional application No. 60/346,169, filed on Oct. 24, 2001.

(51) Int. Cl.[7] ..... F02B 47/08
(52) U.S. Cl. ..... 123/568.11; 277/616; 285/261
(58) Field of Search ..... 123/568.11; 277/616, 277/602; 285/261, 231, 374, 379

(56) References Cited

U.S. PATENT DOCUMENTS 4,311,313 A * 1/1982 Vedova et al. ..... 277/507
5,069,487 A * 12/1991 Sheppard ..... 285/226
5,362,229 A * 11/1994 Yamaga ..... 432/152
6,328,347 B1 * 12/2001 Reder et al. ..... 285/261

* cited by examiner

*Primary Examiner*—Bibhu Mohanty
(74) *Attorney, Agent, or Firm*—Ephraim Starr

(57) ABSTRACT

A flexible gas connection joint for use with an exhaust gas recirculation system is located between an engine exhaust manifold and a turbocharger. The flexible joint comprises a hot pipe for connection with an exhaust gas source. The hot pipe has a first end for connecting with the exhaust gas source, and has a second oppositely positioned end for connecting with an exhaust gas receiving member. The hot pipe second end includes a generally cylindrical outside surface. An adapter is coupled to the hot pipe second end for receiving exhaust gas therefrom. The adapter has a cylindrical inside diameter, and the hot pipe second end is disposed within the cylindrical inside diameter. The hot pipe second end has a radiused outside surface for enabling three-dimensional movement of the hot pipe second end within the adapter. The flexible joint can include a sealing ring interposed between concentric hot pipe and adapter surfaces for providing a leak-tight seal therebetween.

8 Claims, 6 Drawing Sheets

| Vertical Distance from top | Taper Angle | Hot Pipe Diameter (mm) | Comments |
|---|---|---|---|
| 0 | | 55.27 | Top (0.5mm chamfer) |
| −0.5 | −26.6 | 55.77 | Start of Profile |
| −3.2 | −4.0 | 56.14 | |
| −5.7 | −1.5 | 56.27 | 4mm Flat region |
| −9.7 | 0.0 | 56.27 | |
| −13.7 | .9 | 56.14 | |
| −18.0 | 2.5 | 55.77 | |
| −21.7 | 3.9 | 55.27 | Bottom |

EGR SYSTEM FLEXIBLE GAS CONNECTION JOINT

RELATION TO COPENDING PATENT APPLICATION

This patent application claims priority of U.S. Provisional Patent Application No. 60/346,169 filed on Oct. 24, 2001.

FIELD OF THE INVENTION

The present invention relates to exhaust gas recirculation (EGR) systems, and more particularly, to an EGR system flexible gas connection pipe joint.

BACKGROUND OF THE INVENTION

EGR systems are designed to recirculate exhaust gas generated by an internal combustion engine back into an engine intake stream. Since the exhaust gas exiting the engine is already combusted, it does not combust or burn again when it is recirculated back into the combustion chamber, thereby acting to displace some of the normal intake charge. The effect of adding such exhaust gas to the intake charge operates to chemically slow and cool the combustion process by several hundred degrees, thereby acting to reduce NOx formation.

For this reason, EGR systems have gained widespread acceptance and application for use with the many different types of gasoline and diesel internal combustion engines that are used to power vehicles such as cars and trucks. The addition of such an EGR system to heavy duty diesel engines requires that an additional exhaust connection port be configured that is positioned upstream of the turbocharger, i.e., before the entry point of exhaust gas from the engine into the turbine housing. The new connection port can either be configured as part of the turbocharger or as part of the exhaust manifold.

In such an EGR system application, the new connection port is coupled to an EGR valve (or other EGR system device) via suitable metal piping. A problem that arises with this connection configuration, however, is the fact that the two ends of the EGR system exhaust connection, i.e., between the hot pipe end from the connection point on the turbocharger or the exhaust manifold itself and the pipe connected to the EGR valve, are made from different types of metallic materials and/or are exposed to different operating temperatures, thereby having different thermal expansion and contraction characteristics during engine operation. Such differences in thermal expansion and contraction characteristics are know to cause three-dimensional movement between the two connection points, making the task of providing a leak-tight seal between the two very challenging.

Because the pipe does not run parallel to the engine, it does not expand in two dimensions, but rather expands and moves in a three-dimensional vector space. This makes the connecting joint challenging because one cannot use traditional slip joints as are used on exhaust manifolds.

It is, therefore, desirable that a new joint connection be configured that is capable of accommodating three-dimensional movement between the connecting ends of an EGR system known to occur during engine operating cycles. It is further desired that such new joint connection be relatively easy to install, without the need for special installation tools and the like.

SUMMARY OF THE INVENTION

The present invention is directed to a flexible joint for use in transporting exhaust gas in an EGR system. The flexible EGR joint or coupling is designed to accommodate the three-dimensional movement of connecting members caused from thermal effects of engine operation. A flexible connection joint, for use in an internal combustion engine exhaust gas transport system, comprises a hot pipe or connection with an exhaust gas source. The hot pipe has a first end for connecting with the exhaust gas source, and a second oppositely positioned end for connecting with an exhaust gas receiving member. The hot pipe second end has a generally cylindrical outside surface.

The flexible EGR joint includes an adapter that is coupled to the hot pipe second end for receiving exhaust gas therefrom. The adapter comprises a cylindrical inside diameter, and the hot pipe second end is disposed within the cylindrical inside diameter.

A key feature of this invention is the fact that the hot pipe second end has a radiused, i.e., barrel-shaped, outside surface. This radiused surface configuration is provided to enable lateral, i.e., three-dimensional, movement of the hot pipe second end within the adapter, thereby operating to accommodate the actual thermally-affected movement of the connection members.

A sealing means is interposed between the hot pipe end and the adapter to ensure a leak-tight seal therebetween during such movement. The sealing means can be in the form of a sealing ring that resides within a ring groove disposed within the hot pipe end outside surface. Alternatively, the sealing means can be in the form of one or more sealing rings or washers that are disposed around the hot pipe end outside surface. In either case, the sealing means operates to provide a leak-tight seal, thereby preventing the leakage of gas between opposed concentric hot pipe and adapter surfaces.

BRIEF DESCRIPTION OF THE DRAWINGS

The aspects of the present invention are more readily understood when considered in conjunction with the accompanying drawings and the following detailed description wherein.

DETAILED DESCRIPTION

Flexible EGR system connection joints of this invention generally comprise a hot side connection member (hot pipe)

and an EGR valve or EGR device side connection member (adapter) that are each configured in a complementary manner to accommodate three-dimensional movement between the respective connection member while also maintaining a leak-tight seal therebetween.

Figure 1:
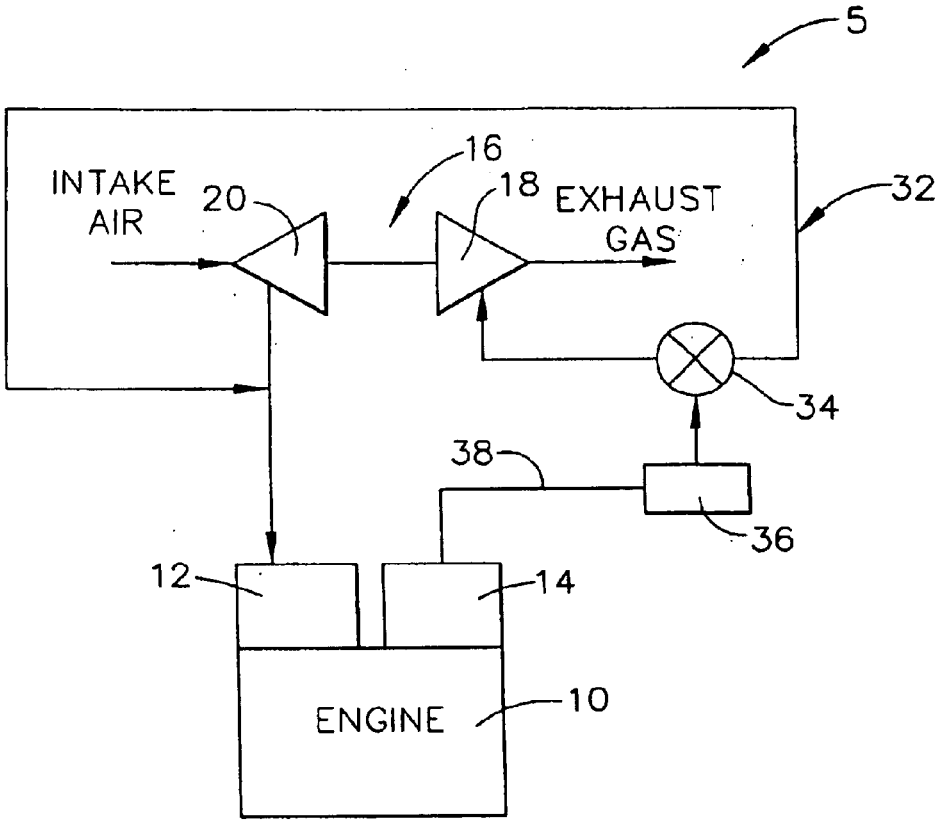
FIG. 1 is a schematic diagram of an internal combustion engine system having a turbocharger and an EGR system.

Flexible EGR system gas connection joints of this invention are intended to be used with turbocharged or non-turbocharged gasoline and/or diesel-powered internal combustion engines. FIG. 1 illustrates a conventional turbocharged internal combustion engine system 5 comprising an engine 10 having an intake manifold 12 and an exhaust manifold 14. In the illustrated embodiment, the engine includes a turbocharger 16, generally comprising a turbine 18 (for receiving exhaust gas from the engine exhaust manifold) and a compressor 20 (for receiving and compressing intake air before being routed for combustion in the engine).

The engine 10 also includes an EGR system, generally designated as 32. The EGR system includes an EGR control valve 34 that is interposed between the turbocharger 16 and the engine 10 and connected therebetween by suitable piping and/or manifolding. The EGR valve 34 operates to receive and regulate the proportion of exhaust gas that is taken from the exhaust manifold and either returned to the engine induction system for mixing with the intake air or directed to the turbine of the turbocharger. The EGR system comprises a flexible connection joint of this invention 36 for connecting a hot pipe 38 coming out of the exhaust manifold 14 to the EGR valve 34, or possibly (in an alternative EGR system configuration) some other type of EGR system device). The flexible connection joint of this invention is useful to provide a leak-tight connection in an EGR system between two connection members having different thermal expansion characteristics.

Figure 2:
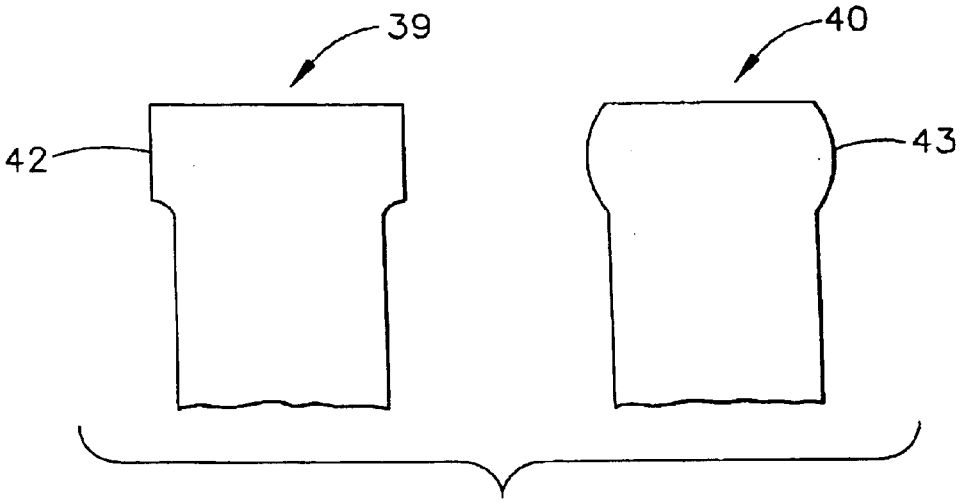
FIG. 2 is a schematic side view of a hot pipe end constructed according to an embodiment of the present invention that is positioned alongside an alternative hot pipe end of this invention.

FIG. 2 illustrates the difference that exists between a conventional EGR connection member 39, i.e., a hot pipe end, and a hot pipe end 40 constructed according to an embodiment of the present invention. As evident in FIG. 2, the conventional hot pipe 40 is configured having a straight cylindrical surface profile 42 that is designed to possibly accommodate only two-dimensional movement, i.e., concentric axially directed in-and-out sliding longitudinal movement with a complementary connection member. The hot pipe 40 of this invention, however, is configured having a radiused cylindrical surface profile 4 to provide some degree of lateral movement within a complementary connection member in addition to the longitudinal movement to better accommodate the three-dimensional thermal-related movement between the connection members.

Figure 3:
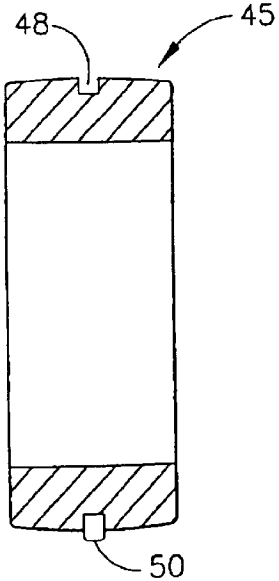
FIG. 3 is a cross sectional side view of a hot pipe end constructed according to an embodiment of the present invention.

As shown in FIG. 3, a hot pipe end 45, constructed according to an example embodiment of this invention, comprises a generally radiused outside cylindrical surface 45. The degree to which this surface is radiused will depend on many factors, such as the size of the pipe end, the type of material that is used, the particular use application, and the like. In an example embodiment, where the hot pipe end has an axial length of approximately 26 mm, an outside diameter of approximately 62 mm, and an inside diameter of approximately 44 mm, the outside surface of the hot pipe end 45 is imparted with a radius of curvature of approximately 153 mm.

A ring grove 48 is disposed a depth circumferentially within the outside surface of the hot pipe, and is positioned axially generally along a midpoint of the surface. The ring groove 48 is sized and configured to accommodate placement of a sealing ring 50 therein. The sealing ring 50 is sized and shaped to reside in the groove and project radially outwardly therefrom, and away from the surface of the hot pipe, a defined distance to provide a sealing interface with a complementary sealing surface of an adapter connection member.

The hot pipe end is formed from a conventional metallic material, and may be made by machining a barrel shape into the outside surface. In an alternative embodiment, the hot pipe end may be made through a net shaping process, such as by powdered metal process.

Figure 4:
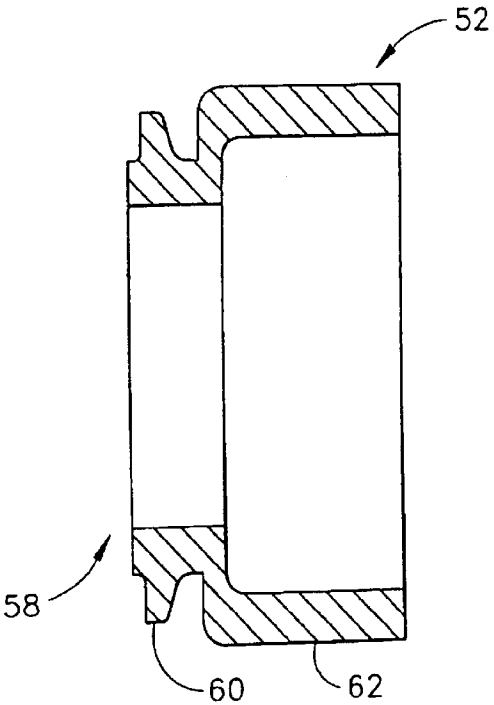
FIG. 4 is a cross sectional side view of an adapter according to a first embodiment of the present invention.

The hot pipe end is designed to be inserted into a complementary connection member that is hereby referred to as an adapter. An adapter 52, constructed according to a first embodiment of the present invention, is shown in FIG. 4. Moving from left to right in FIG. 4, the adapter 52 comprises a first end section 58 that is configured for coupling to an EGR system valve, other EGR system device, or EGR system transfer pipe (not shown). As shown in FIG. 4, the adapter may include a flange 60 positioned adjacent to the first end section 58 for facilitating connection with, e.g., an EGR valve.

Moving axially away from the first section end 58, the adapter comprises a second enlarged diameter section 62 comprising an inside cylindrical surface having a diameter generally larger than that of the first section end. The second section has a planar cylindrical surface, i.e., constant inside diameter, that is sized (inside diameter and axial depth) to accommodate placement of the hot pipe end therein. In the example embodiment wherein the adapter is sized to complement the hot pipe end of FIG. 3, the adapted second section 62 is configured having an inside diameter of approximately 63 mm, an axial depth of approximately 30 mm, and an outside diameter of approximately 77 mm.

Figure 5:
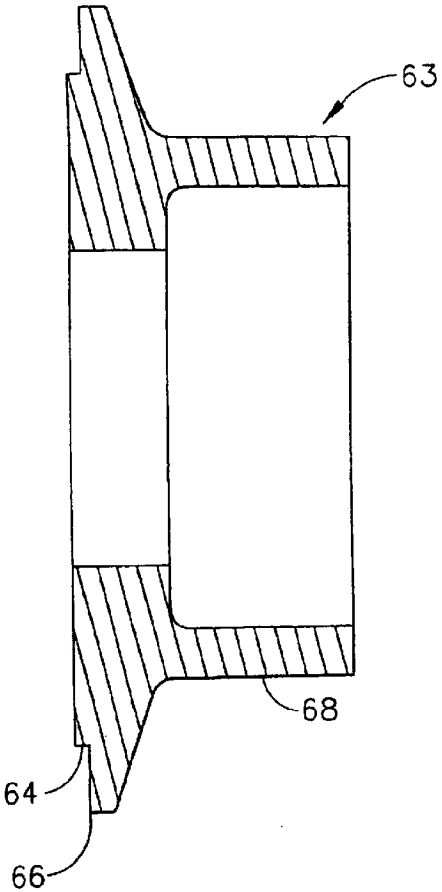
FIG. 5 is a cross sectional side view of an adapter according to a second embodiment of the present invention.

FIG. 5 illustrates a second embodiment adapter 63 of this invention. This adapter is generally similar to that described above and illustrated in FIG. 4, with respect to the size, configuration, and purpose of the second section 68, with the difference being in the shape of the first section and respective mating flange. This particular adapter comprises a first section 64 having a reduced inside diameter and a radially enlarged connecting flange 66, when compared to the adapter of FIG. 4. It is to be understood that the size and configuration of the first section of adapters of this invention can and will vary depending on the particular use application.

In an embodiment of this invention, one or more rings are interposed between the concentrically arranged hot pipe end outside surface and the adapter second section inside diameter surface to provide a leak-tight seal therebetween. The ring or rings prevent leakage due to the sealing forces of the ring against the inside of the adapter.

Figure 6A:
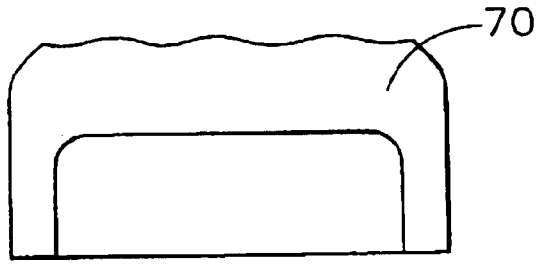
FIGS. 6A–6C are schematic views of an adapter, a ring, and a hot pipe end, respectively, each constructed according to an embodiment of the present invention.
Figure 6B:
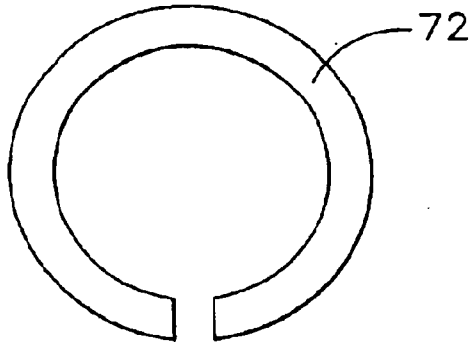
Figure 6C:
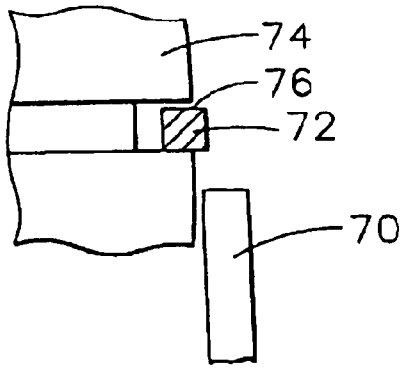

A system utilizing a ring according to an embodiment of this invention is shown in FIGS. 6A, 6B, and 6C. FIG. 6A illustrates an adapter 70 of this invention having, for a specific example application, an inner diameter of about 62.76 mm. FIG. 6B illustrates a ring 72 of this invention having, for the same specific example application, having an outer diameter of approximately 62.71 mm. The ring 72 is made from metal and is configured having a piece removed therefrom to provide desired fitment, flexibility, and loading characteristics.

FIG. 6C illustrates a hot pipe end 74 comprising a ring groove 76 disposed a desired depth into the outside surface, at a location along the axial midpoint of the hot pipe, e.g., at a location on the hot pipe end where the external diameter is at a maximum. In the embodiment shown in FIG. 6C, the adapter 70 has an inner diameter of about 62.76 mm, and the hot pipe end 74 has an outer diameter of about 61.74 mm, reflecting the radiused profile of the outside surface.

Figure 7A:
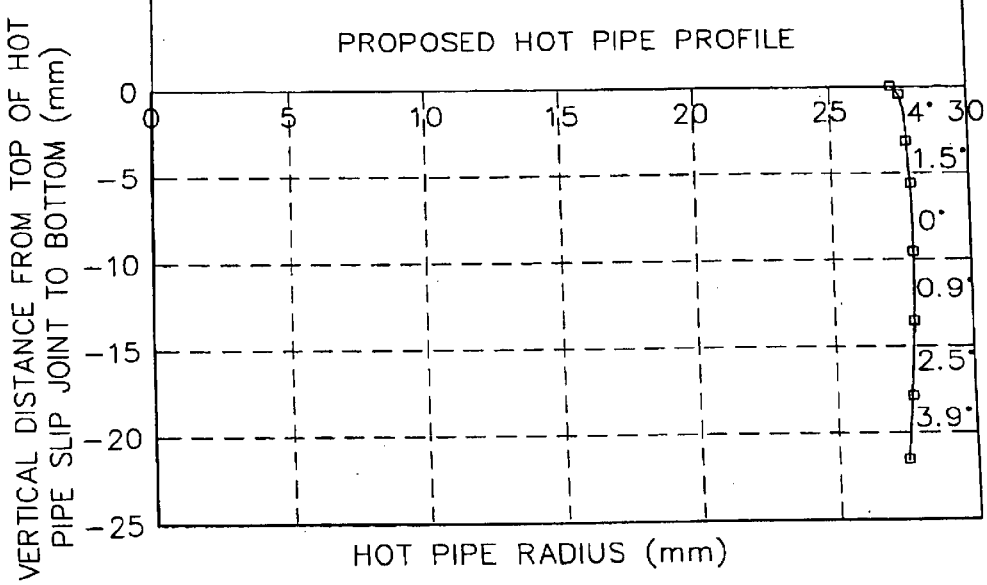
FIGS. 7A and 7B present hot pipe profile date for hot pipes constructed according to an embodiment of the present invention.

FIG. 7A sets forth in both tabular and graphical form data relating to the surface profile of a hot pipe end of this invention configured for a particular application. Again, it is to be understood that such profile data is provided for purposes of reference only, to better understand and appreciate the specific surface profile of the hot pipe end, and is specific to a hot pipe configured for a particular application. Therefore, it is to be understood that hot pipes of this invention can and will have differently radiused surface profiles.

For this particular embodiment, however, a hot pipe end has at a top end an outer diameter of about 55 mm. The outer surface of the hot pipe end tapers outward until the outer diameter reaches a maximum of about 56 mm at a location about 6 mm from the end. The outer diameter remains flat at about 56 mm until about 10 mm from the end. The outer surface then tapers inward until the outer diameter reaches a minimum of about 55 mm again at a distance of about 22 mm from the end.

Figure 7B:
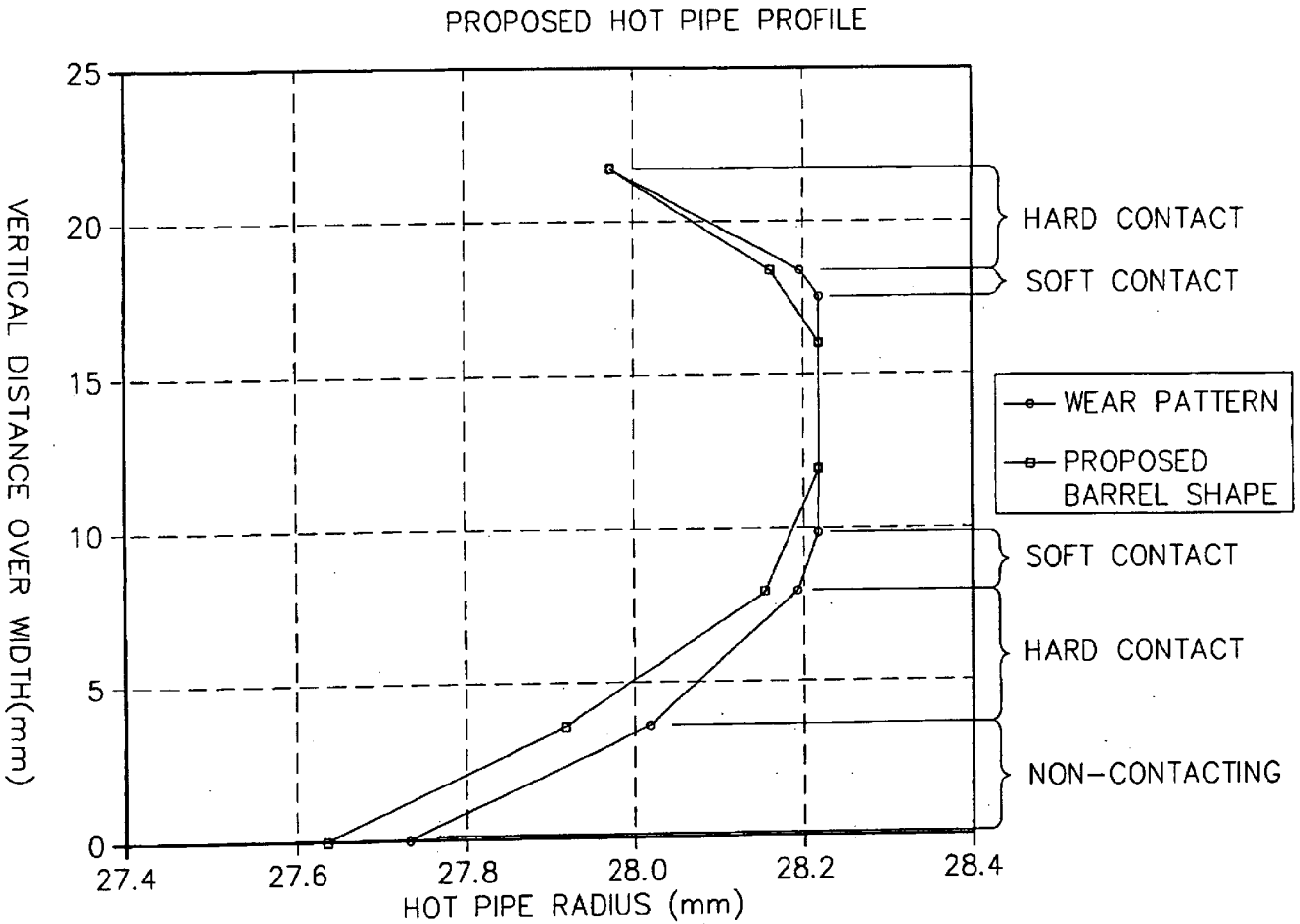

FIG. 7B presents hot pipe end profiles data in graphical form as a function of both hot pipe radius and vertical distance over width.

Figure 8:
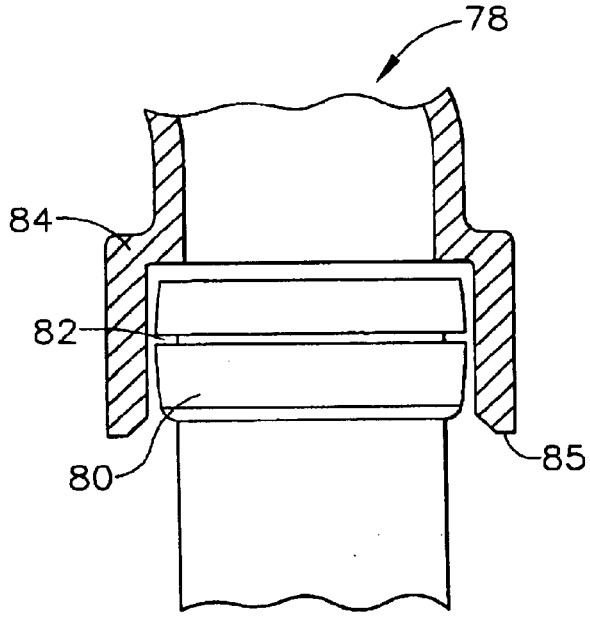
FIG. 8 is a cross sectional side view illustrating a flexible connection joint of this invention provided by a hot pipe/with ring coupled inside of an adapter.

FIG. 8 illustrates a flexible EGR system gas connection joint 78 of this invention comprising the hot pipe end 80, sealing ring 82, and adapter 84 as described and illustrated above. Specifically, the flexible connection joint 78 is formed by placement of the hot pipe end 80 within the second section of the adapter 84. The ring 82 is disposed within the hot pipe end ring groove and placed into sealing interface with a concentric surface of the adapter second section inside diameter surface. In this particular example embodiment, a clearance in the range of from about 0.002 to 0.1 mm is provided between the concentric hot pipe end and adapter surfaces. This clearance is created by tapering each end of the hot pipe end 80 radially inwardly (provided by the radiused outside surface profile) and by tapering an inner surface of the adapter 84 radially outwardly adjacent to adapter end 85.

The clearance that is intentionally created between these cooperating connection members serves not only to provide longitudinal in-and-out (i.e., two-dimensional) movement between the respective members, but provides a desired degree of lateral (i.e., three dimensional) movement between the respective members. Yet, the clearance is not so great so as to maintain the desired leak-tight seal provided by the ring seal within the flexible joint.

Figure 9:
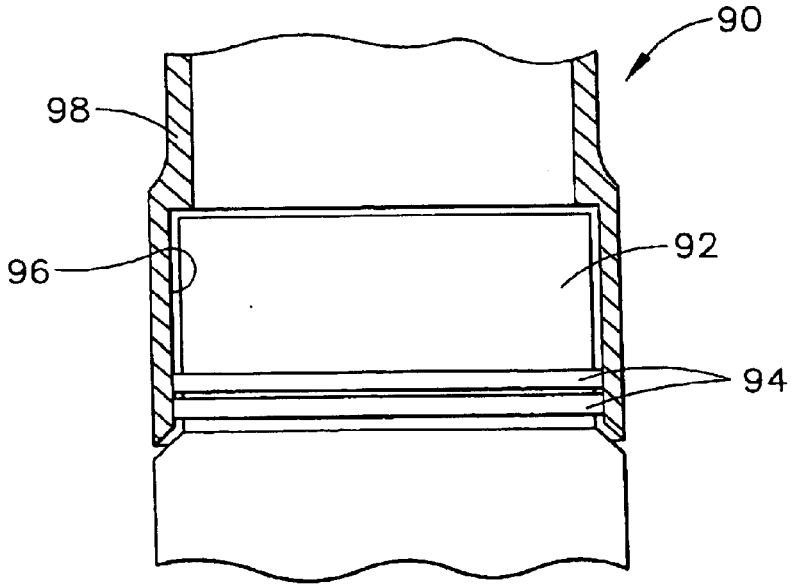
FIG. 9 is a cross sectional side view illustrating a flexible connection joint of this invention provided by a hot pipe/with washers coupled inside of an adapter.

FIG. 9 illustrates an another embodiment of a flexible EGR system gas connection joint 90 of this invention. In this particular embodiment, the hot pipe end 92 is configured (rather than having a ring seal disposed within a ring groove) having a number of washers 94 disposed around its outside surface. The washers 94 operate to both provide a leak-tight seal between the hot pipe end and inside diameter surface 96 of the adapter 98, and to maintain such seal which accommodate the desired three-dimensional movement between the connecting members.

Having now described the invention in detail as required by the patent statutes, those skilled in the art will recognize modifications and substitutions to the specific embodiments disclosed herein, which modifications and substitutions are understood to be within the scope and intent of the present invention.

What is claimed is:

1. A flexible connection joint comprising:

a hot pipe for connection with an engine exhaust gas source, the hot pipe having a first end for connecting with the exhaust gas source, and a second oppositely positioned end for connecting with an exhaust gas receiving member; and an adapter coupled to the hot pipe second end for receiving exhaust gas therefrom, the adapter comprising a substantially cylindrical inside diameter, wherein the hot pipe second end is disposed within the inside diameter;

wherein an outside surface of the hot pipe second end is radiused for enabling three-dimensional movement of the hot pipe second end within the adapter during operation of the engine.

2. The flexible connection joint as recited in claim 1 wherein the hot pipe and adapter are interposed between an engine exhaust manifold and an exhaust gas recirculation system valve.

3. The flexible connection joint as recited in claim 1 further comprising at least one sealing member disposed substantially circumferentially around the hot pipe second end to provide a leak-tight seal between the hot pipe second end and the adapter.

4. The flexible connection joint as recited in claim 1 wherein the hot pipe and adapter are interposed between an engine exhaust manifold and a turbocharger.

5. The flexible connection joint as recited in claim 3 wherein said at least one sealing member comprises at least one item selected from the group consisting of a ring, sealing ring, and washer.

6. The flexible connection joint as recited in claim 5 wherein said at least one sealing member comprises metal.

7. The flexible connection joint as recited in claim 3 wherein said outside surface comprises at least one circumferential groove to receive the at least one sealing member.

8. The flexible connection joint as recited in claim 7 wherein said at least one groove is located at a point of maximum outside diameter of the hot pipe second end.

* * * * *